US012729453B2

(12) United States Patent
Tanaka et al.

(10) Patent No.: US 12,729,453 B2
(45) Date of Patent: Sep. 8, 2026

(54) ALUMINUM OR ALUMINUM ALLOY MATERIAL, AND PRODUCTION METHOD THEREFOR

(71) Applicant: ART1 Inc., Kanagawa (JP)

(72) Inventors: Shigenori Tanaka, Kanagawa (JP); Kazuhito Nishinaka, Kanagawa (JP); Masahiro Akimoto, Kanagawa (JP)

(73) Assignee: ART1 Inc., Kanagawa (JP)

( * ) Notice: Subject to any disclaimer, the term of this patent is extended or adjusted under 35 U.S.C. 154(b) by 276 days.

(21) Appl. No.: 18/549,101

(22) PCT Filed: Nov. 10, 2022

(86) PCT No.: PCT/JP2022/041868

§ 371 (c)(1),
(2) Date: Sep. 5, 2023

(87) PCT Pub. No.: WO2023/090242

PCT Pub. Date: May 25, 2023

(65) Prior Publication Data

US 2024/0287701 A1 Aug. 29, 2024

(30) Foreign Application Priority Data

Nov. 18, 2021 (JP) ..... 2021-200429

(51) Int. Cl.
*C25D 11/18* (2006.01)
*C23C 28/00* (2006.01)
(Continued)

(52) U.S. Cl.
CPC ..... *C25D 11/18* (2013.01); *C23C 28/30* (2013.01); *C23C 30/00* (2013.01); *C25D 11/246* (2013.01)

(58) Field of Classification Search
CPC ..... C23C 28/30; C23C 28/32; C23C 30/00; C25D 11/18; C25D 11/20; C25D 11/22; C25D 11/24
See application file for complete search history.

(56) References Cited

U.S. PATENT DOCUMENTS 5,158,663 A * 10/1992 Yahalom ..... C25D 11/12 205/171
6,495,271 B1 * 12/2002 Vakil ..... C23C 28/00 428/629
2010/0005792 A1 * 1/2010 Saiki ..... F01N 13/08 165/185

FOREIGN PATENT DOCUMENTS

JP 50-113434 A 9/1975
JP 51-3333 A 1/1976
(Continued)

OTHER PUBLICATIONS

International Search Report and Written Opinion mailed Jan. 24, 2023, in PCT Application No. PCT/JP2022/041868 in 10 pages.
(Continued)

*Primary Examiner* — Brian W Cohen
(74) *Attorney, Agent, or Firm* — Knobbe, Martens, Olson & Bear, LLP

(57) ABSTRACT

[Problem to be Solved] To develop a material of aluminum anode-oxidization layer with an antistatic performance and hardness.
[Means for Solving Problem] The present invention provides a material having the combination of antistatic, electro-magnetic shield, and electric conductive properties immediately provided to practical use which are not known conventionally by forming 10-1000 cracks having a width from 0.1-10 μm per arbitrary one end face of 1 $cm^2$, depositing or precipitating metal in and nearby the cracks,
(Continued)

and then forming between a substrate and a surface an electric-conductive layer not more than $10^3\Omega$.

13 Claims, 4 Drawing Sheets

(51) Int. Cl.
*C23C 30/00* (2006.01)
*C25D 11/24* (2006.01)

(56) References Cited

FOREIGN PATENT DOCUMENTS

| | | | |
|---|---|---|---|
| JP | 2002-332578 | A | 11/2002 |
| JP | 2006-291259 | A | 10/2006 |
| JP | 2015-137401 | A | 7/2015 |
| JP | 6470493 | B2 | 2/2019 |
| JP | 2019-147988 | A | 9/2019 |
| JP | 2021-70865 | A | 5/2021 |
| JP | 2021-181609 | A | 11/2021 |
| WO | WO 00/01865 | A1 | 1/2000 |
| WO | WO 2023/079671 | A1 | 5/2023 |

OTHER PUBLICATIONS

International Search Report and Written Opinion mailed Jan. 18, 2022, in PCT Application No. PCT/JP2021/040703 in 9 pages.
Fukuda et al., "Electrodeposition of Nickel and Zinc into the Pores of Anodic Oxide Film on Aluminum," *Journal of the Surface Finishing Society of Japan*, vol. 33, No. 5, pp. 232-237 (1982).

* cited by examiner

ALUMINUM OR ALUMINUM ALLOY MATERIAL, AND PRODUCTION METHOD THEREFOR

CROSS-REFERENCE TO RELATED APPLICATIONS

This application is a national stage application under 35 U.S.C. § 371 of International Application No. PCT/JP2022/041868, filed Nov. 10, 2022, which claims priority benefit to JP 2021-200429, filed Nov. 18, 2021. Each of the foregoing applications is hereby incorporated by reference in its entirety.

TECHNICAL FIELD

The present invention relates to a material of aluminum or its alloy having superior antistatic and electric properties.

BACKGROUND ART

An aluminum anode-oxidization film (hereunder referred to alumite) has developed as electric insulator material and has played an important role in recent developments of aluminum through improvements in decoration-imparting technologies, corrosion resistance technologies, and hardness and/or anti-abrasion technologies and the like. In recent electronic devices, casings and parts and the like of products including semiconductors are applied to alumite processing or coatings for preventing scratches and corrosion and the like; however, when the alumite is used, there are many accidents that damage electronic circuits by statistical electricity, because the film has an insulating property of $10^6$-$10^8\Omega$. To avoid this, with decreasing the electric resistance of alumite stepwise depending on their purposes, the anode-oxidization film, developments thereof and commercial realization have been waited while defeating the concept of insulation material that is original nature and having respective-stepwise electric property as well as conventional properties, have been waited for addressing to problems such as providing a countermeasure for the accidents by statistical sparks, creating an electric and magnetic fields shield effect in an electric-wave region used in smartphone, satellite broadcasting and a radio cab, making an electric-earth location flexible due to electronic conductivity, and decreasing costs due to omission of masking steps, have been waited.

The anode-oxidization film of alumite is composed of a porous layer and a barrier layer and is widely used as the insulation material. Besides, in 1970-80 decades, as hardening method of sulfuric film, a paper has been issued that reports electronic conductivity when the barrier layer was removed, and metal was deposited to the porous layer using an electro-coloring technology (Non-patent Literature 1)

The film hardness attained in this paper is about to be HV330 at most and has the defect that the corrosion resistance of film do not remain at all depending on cases. Furthermore, it is surely confirmed that the volume resistance between a surface and a base substrate becomes low, however, if this material is used for the purposes of spark prevention or electric-destruction prevention of electronic devices, the electric conduction performance may be destroyed relatively easily, because the pores in the porous layer to which the metal is deposited are absolutely fine hole having a diameter of 10-100 nm or less, and these pores are independent each other such that the metal diameter deposited in the pore one by one is absolutely fine so that the flowing current under voltage application may be extremely low with respect to each of pores, and deposits in all pores does not reach the base substrate layer; and hence, sufficient conductivity cannot obtained without enlarging contact area. For example, no problem occurs when one LED is turned on by a 6V-dry element battery; however, an 1.5V miniature light bulb lights instantaneously and might go out immediately when trying to light on it. Thus, it has become clear that long-term usage is difficult, and it is insufficient to apply wide usage.

An original technology for the anode-oxidization film of aluminum metal is to avoid cracks and generation of cracks is known for special purposes. For example, the technology, which improves heat resistance of the aluminum material for using it to an engine of an automobile and the like, is disclosed by applying an admixture system of ceramics and low-melting point glass on a cracked surface formed by heat-processing of 450° C. while filling them in the cracks and same time forming a ceramics coating on the entire film as a multi-layered coating (Patent Literature 1). According to this method, the low-melting point glass and ceramics can be repeatedly coated on the anode-oxidization film; however, these components cannot be filled only in the ceramics. On the other hand, if various substances can be filled substantially only in the cracks, it becomes possible to impart novel performances to the aluminum base material while remaining original features of the anode-oxidization film.

PRIOR ART LITERATURE

Non-Patent Literature

Non-Patent Literature 1: Journal of the Surface Finishing Society of Japan, Vol. 33 No. 5, 232-237 (1982)

Patent Literature

Patent Literature 1: Japanese Patent No. 6470493

SUMMARY OF INVENTION

Technical Problem

The present invention provides an aluminum material and an material consisted of alloys thereof with light-weighted while having wide applicability and a production method of the same, which has low-volume resistance providing conductivity between an alumite surface and a base substrate and of which low-resistance value is stable in any usage forms and embodiments.

Solution to Problem

According to an aspect according to the present invention, an aluminum or aluminum alloy material is provided. The aluminum or aluminum alloy material comprises an anode-oxidization film structure having an anode-oxidization film, a barrier layer and electric conductive metal on an aluminum base substrate surface, wherein cracks having widths of 0.1-10 μm viewed from a surface are present in a of 10-1000 per 1 $cm^2$ in average and the electric conductive metal is present in the cracks and near surfaces of the cracks, wherein 5% or more of a total crack number reaches the base material passing through the barrier layer, wherein a volume resistance value between the surface of the anode-oxidization film and the base substrate is not more than 1000 ($10^3$)Ω measured by a 4-terminal method, and wherein the anode-oxidization film has a hardness nor less than Vickers Hardness of HV300.

An average number of the cracks is the average number of the cracks per one end face which cross four end faces of 1 $cm^2$ optionally cut from the anode-oxidization film, wherein the cracks include connection points to the other crack each other, and wherein the electric conductive metal is present near the surfaces of the cracks and the surface of the material is mainly the anode-oxidization film.

The electric conductive metal can be deposited or precipitated in liquid or in gas at normal pressure or reduced pressure, and a part of the metal is continuous from the surface of the anode-oxidization film to the base substrate.

The electric conductive metal is preferably deposited or precipitated in liquid or in gas at atmospheric pressure or reduced pressure, and a part of the metal is continuous from the surface of the anode-oxidization film to the base substrate.

An abrasion resistance of a layer forming the anode-oxidization film is preferably not less than 30 ds/μm by a reciprocal movement plane abrasion test in a general film condition.

An average volume resistance value is preferably not more than 10 ($10^1$)Ω, and an electro-magnetic shield effect is not less than 30 dB within a wavelength region of 500 KHz-1 GHz.

Corrosion resistance by a neutral salt water spraying test machine in 120 hours is preferably not less than RN9.

The anode-oxidization film has preferably a film thickness of 6-60 μm and is able to adjust color tones.

According to a second aspect of the present invention a method for producing an aluminum or aluminum alloy material is provided. The method comprises:

- a first step of forming an anode-oxidization film by an anode-oxidization process at solution temperature of 0° C.-25° C.;
- a second step of forming 10-1000 cracks per 1 $cm^2$ in average, the cracks having widths of 0.1-10 μm when viewed from a surface of the anode-oxidization film by heating to 100-350° C. in a liquid or in a gas at atmospheric pressure or reduced pressure;
- a third step of depositing and/or precipitating metal in the cracks and near surfaces of the cracks by vibration precipitation process.

5% or more of a total crack number reaches the base material passing through the barrier layer, wherein a volume resistance value between the surface of the anode-oxidization film and the base substrate is not more than 1000 ($10^3$)Ω measured by a 4-terminal method, and wherein the anode-oxidization film has a hardness nor less than Vickers hardness of HV300.

The second step may include the step of forming the cracks in the anode-oxidization film in liquid such as water, or polyalcohol as a single or an admixture, or in gas such as argon, carbon dioxide, or air as a single or an ad mixture under pressurized or reduced condition from 10 seconds to 30 minute as its time duration.

DESCRIPTION OF SIGNS AND NUMERALS

Figure 1:
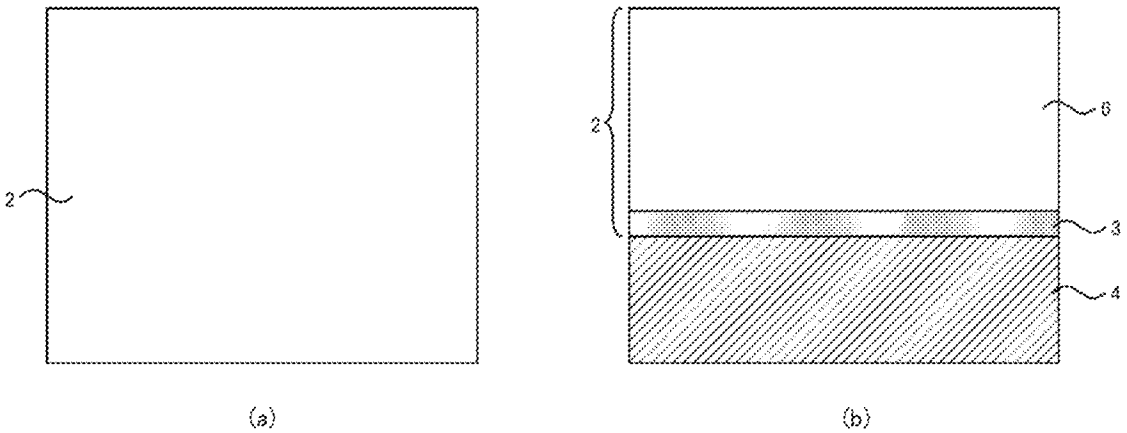
FIG. 1 is schematic views of a surface and a cross section of an anode-oxidization film formed by a first process.

1. crack
2. anode-oxidization film
3. barrier layer
4. base substrate (aluminum)
5. deposition of metal in cracks
6. porous layer
7. ohmmeter: RM3548
8. direct current constant voltage power source
9. voltage meter
10. gold-plated electrode

Embodiment for Practicing Invention

Hereafter, embodiments according to the present invention will be described particularly; however, the present invention should not be limited to the following embodiments. In addition, according to the present specification, the term "about" put prior to numerals has an allowable range within +20% with respect to the numerals or boundary values of numeral range. Furthermore, the terms "mainly" and "generally" put prior to numerals that define a numeral or a range or subjected matters mean to be not less than 50%.

The material of present embodiment includes an anode-oxidization film structure comprising a porous layer, a barrier layer and conductive metal, and cracks of 10-1000 per 1 $cm^2$ having widths of 0.1-10 μm are present when viewed from a film surface, and the metal is preferably present in the cracks and near to the surface of cracks. In addition, the material of the present embodiment about 5% or more of a total crack number reaches the base substrate passing through the barrier layer, and an average volume resistance value between the film surface and the base substrate measured by a 4-terminal method preferably has a performance not more than 1000 ($10^3$) Ω while preferably having the film hardness not less than HV300 according to a Vickers Hardness testing machine.

Measurements of volume resistance for the material according to the present invention can be performed by a direct-current 4-terminal method (voltage drop method) using an ohmmeter RM3458 (available from Hioki E.E. Corporation). The volume resistance between the surface and the base substrate shows electric conductivity not more than 1000 ($10^3$) Ω and can keep for long-term low volume resistance value without destructions of conductive circuits independently of much or less of quantity of supplied current. Thus, the material of the present embodiment can be widely used and applied to various fields.

The aluminum group material of the present invention may have 10-1000 cracks per 1 $cm^2$ in average having widths of 0.1-10 μm. More than 5% of these cracks reaches the base substrate layer of aluminum group from the surface while passing through the barrier layer, and preferably, the electric conductive metal exists in the cracks. Furthermore, a part of the metal more preferably exists continuously from the surface of cracks to the base substrate. By the anode-oxidization film structure according to the present embodiment above described, the average volume resistance value can keep not more than 1000 ($10^3$) Ω when electrically measured by the 4-terminal method between the surface and the base substrate.

An average number of cracks in the present embodiment is defined as the average value of crack number per one end face; here, the subjected cracks cross across four end faces of cracked film surface of 1 $cm^2$ cut-out at an optional point. Crack widths on the material surface can be, for example, measured in an automatic measurement by a microscope AxiolmagerA2m available from Carl Zeiss Co., Ltd. at 1000 magnifications. More particularly, the crack widths according to the present embodiment were counted visually and examined using a printed output after images taken at 50 magnifications is printed out.

The aluminum group material according to the present invention has the cracks, of which levels are visually accepted on the film surface, and to each of the cracks, the electric conductive metal is filled in the form that reaches the base substrate from the surface. Depending on the filling rates of electric conductive metal, the volume resistance can be adjusted within the range from 1000 ($10^3\Omega$) to not more than 122. The volume resistance can be adjusted by the filling rates of electric conductive metal in the cracks, and, for example, when the filling rates are set low for providing 1000 ($10^3$) Ω-1Ω, an application only requiring antistatic property may be the targeted application. Besides, in the embodiment that the volume resistivity is set to be 1Ω, wide applications such as applications requiring electro magnetic shield performances, electric conductive performances, and damage protection performances by the spark to electronic parts etc. may be the targeted applications.

A production method of the present invention includes the following processing steps:

(1) a first step of forming an anode-oxidization film by applying an anode-oxidization process to aluminum or its alloy at 0° C.-25° C.;

(2) a second step of forming 10-1000 cracks per 1 $cm^2$ in average, the cracks having widths of 0.1-10 μm when viewed from a film surface by heating to 100-350° C. in a liquid or a gas in an atmospheric pressure or in a reduced pressure; and (3) a third step of depositing and/or precipitating metal in the cracks and near surfaces of the cracks by a vibration precipitation process may be included.

In the material produced by the production method according to the preferred embodiment, preferably cracks not less than 5% of the total crack number reaches the base substrate layer passing through the barrier layer. Furthermore, the material produced by the production method according to the preferred embodiment preferably has the volume resistance value not more than 1000 ($10^3$) Ω when measured between the film surface and the base substrate by the 4-terminal method. Besides, the material produced by the production method according to the preferred embodiment preferably has the anode-oxidization film structure having the film hardness not less than HV300 as a measured value obtained by a film cross section method (JIS Z2244) with a Vickers Hardness testing machine. The material produced by the production method according to the present embodiment preferably has the thickness of formed film to be about 20-40 μm. FIG. 1 shows a schematic cross-sectional view of film formed to the produced material according to the present embodiment as FIG. 1.

In the production method for the material of the present invention, electrolysis methods for forming the anode-oxidization film as the first step may uses a waveform as a single or two or more combinations selected from a direct current method, an alternative-direct overlapping method, a pulsed method, and a PR pulsed method. In addition, an inorganic acid and the admixture of inorganic acid and organic acid may be used as the electrolysis solution. In the other embodiment, after finishing the first step, it may be allowed to remove a part of barrier layer from the anode-oxidization film by decreasing the voltage stepwise in the same electrolysis solution to substantially 0V and then to proceed to the crack forming step as the second step. Furthermore, the temperature of electrolysis solution may be in the range of 0° C.-25° C., more preferably of 0° C.-20° C., further preferably of 0° C.-18° C., because the evenness of anode-oxidation film, the high electro magnetic shield effect, and the magnetic field shield effect can be obtained crack formation to the anode-oxidization film in the second step according to the present embodiment may be performed in the liquid such as water, or polyalcohol as a single or an admixture, or in the gas such as for example, argon, carbon dioxide, or air as a single or an admixture under pressurized or reduced condition from 10 seconds to 30 minute as its time duration at 100-350° C., most preferably at 120-250° C. In the present embodiment, in the case where the inert gases such as argon or carbon dioxide etc. are used, an atmosphere furnace is preferably used and when the cracks are formed in the inert gasses, the oxidization around crack locations may preferably be reduced.

Figure 2:
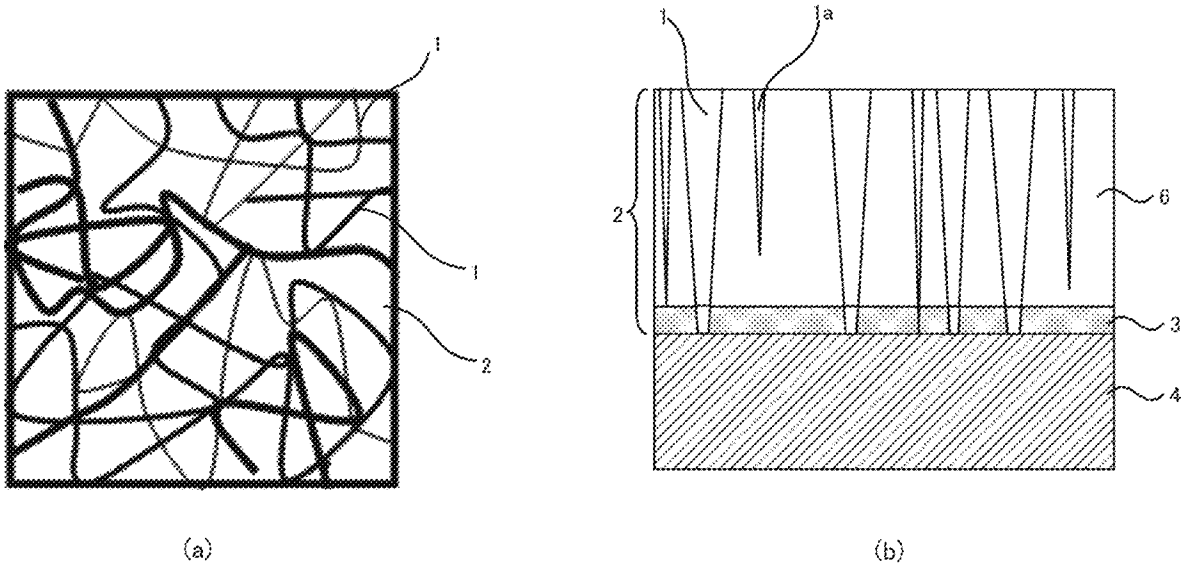
FIG. 2 is schematic views of a surface and a cross section formed by a second process.

The cracks formed preferably have 0.1-10 μm widths and are present preferably in the range of 10-1000 per 1 $cm^2$ in average. Furthermore, each of the cracks preferably includes many positions continuous each other and about 5% or more of the total cracks preferably reaches the base substrate layer with passing through the barrier layer of anode-oxidization film. The cracks have preferably the widths 0.1 μm or more; however, it is not intended to exclude the presence of cracks having the width not more than 0.1 μm; however, according to the present embodiment, the cracks not more than 0.1 μm are excluded in counting from the crack number which is present per 1 $cm^2$. The crack width beyond 0.1 μm is fairly larger in its order than sizes of pores in the porous layer present in the normal anode-oxidization film such that its working is advantageous in filling of metals etc. On the other hand, the cracks having the width not less than 10 μm deteriorate the smoothness and the appearance of material surface such that such cracks are preferably not present. FIG. 2 shows a schematic view of surface and a schematic cross-sectional view when the cracks are formed. In FIG. 2(*b*), the crack 1 illustrates the crack which reaches the base substrate layer 4 and the crack 1*a* illustrate the crack which does not reach the base substrate.

Figure 3:
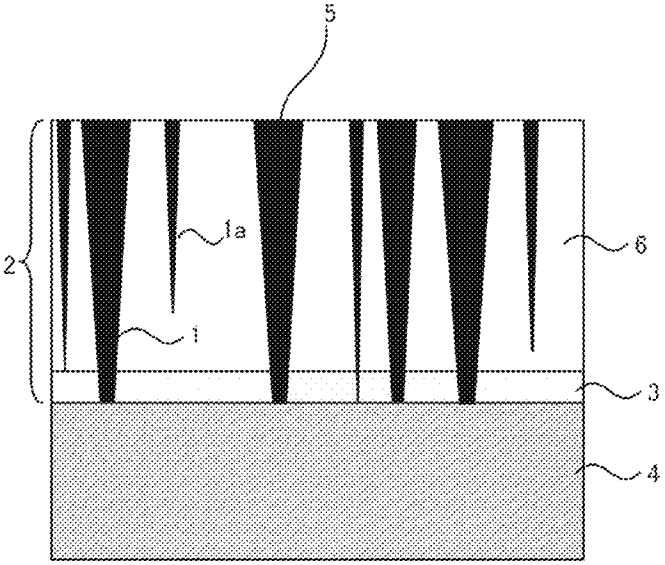
FIG. 3 is a schematic view when metal is deposited in cracks by a third process.

In the third step of the present embodiment, the deposition and/or the precipitation of the metal in the cracks may be applied by an immersing method, an ultrasonic-immersing method, an electrophoresis method, an electrolysis method, or an ion-plating method in a reduced pressure chamber. The metal to be used may include copper, zinc, nickel, tin, gold, silver, palladium, rhodium, and platinum, and especially, gold, silver, zinc and tin, and cupper are preferred. Besides, it is preferred that at least a part of electric conductive metal deposited in the cracks reaches the base substrate layer from the surface with passing through the barrier layer and that metal filling rates in the cracks are equal to or more than about 30%. If the filling rates are too low, the average volume resistance between the surface and the base substrate measured by the 4-terminal method cannot be equal to or less than 1000 ($10^3$) Ω. FIG. 3 shows a schematic cross-sectional view when the metal is deposited or precipitated in the cracks.

The film Vickers Hardness according to the present invention may adopt the values that measured at a weight load of 0.098N (10 grf) for a holding time of 15 seconds according to JIS-Z2244 (Vickers Hardness Test method. The cross-section hardness according to the present embodiment may have the hardness not less than HV300 in the above defined measurement method.

The film thickness may adopt values measured using an eddy-current film thickness meter (LH-373) available from Kett Electric Laboratory Co. Ltd and under JIS-H8680-2 (eddy current system measurement method) after calibration with a standard plate for calibration (plastic film). The thickness of anode-oxidization film according to the present embodiment may preferably range about 6-60 μm, more preferably about 10-50 μm, most preferably about 20-40 μm, and the film has a color tone varying from base substrate color to dark brown or to black and the color tone can be adjusted.

The material according to the present embodiment is one that has the antistatic performance or the electric conductivity, and the difference between the antistatic property and electric conductivity is mainly due to a difference in the volume resistance value. Various different numeral values have been proposed; for example, according to a resin maker, generally the relation with the resistance values are assessed as follows:

- not less than $10^{11}\Omega$: insulator: does not make current flow:
- not less than $10^{9}\Omega$: dispersion property for static electricity: does not make static electricity remained:
- not less than $10^{5}\Omega$: allows static electricity to escape blandly and gradually:
- not less than $10^{1}\Omega$: allows static electricity to escape rapidly.

The antistatic property is the performance that escapes the static electricity charged on an object and this is approximately proportional to the volume resistance value. In addition, the normal antistatic property is provided with the volume resistance value of $10^{9-13}$, and the diffusion property for the static electricity is assessed to be $10^{6-8}$; however, these assessments are different among makers. An antistatic agent and a dispersant providing the static electricity include ionic, nonionic, amphoteric surfactants and silicone groups, or the antistatic property may be imparted by mixing metal ions etc. into resin, and the like. One that has the resistance value of $10^{1-5}\Omega$ is known as a composite or as an electric conductive paint for applying or mixing with mixing carbon to the material, and the antistatic performance according to the present material has the same level as that obtained by carbon not more than $10^{3}\Omega$ in the volume resistance value. The usage within this range includes suitably antistatic performances for recent electronic devices, semiconductor devices, electric conductive mats, floor materials, and floors rather than high voltage usage such as conventional 100V, 200V and the like.

Figure 4:
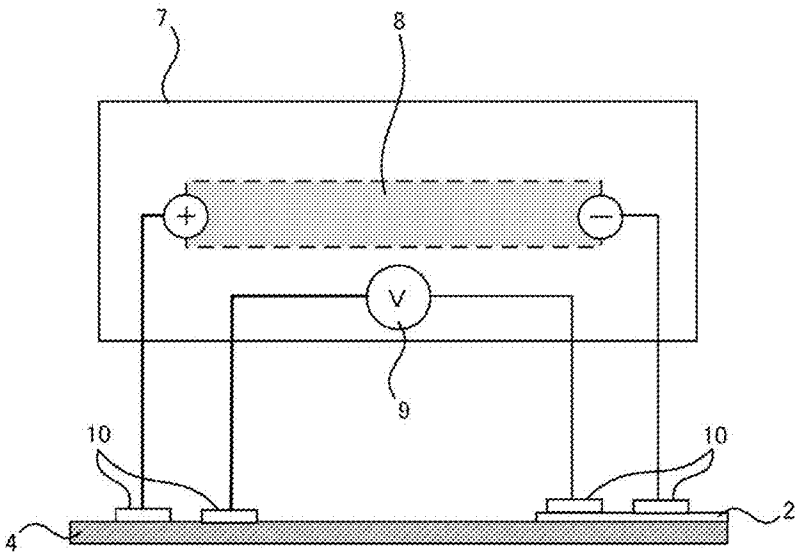
FIG. 4 is a schematic view of 4-terminal measurement method according to a direct current system.

Now, the measurement method of volume resistance according to the present embodiment is shown in FIG. 4. In this embodiment, a direct-current type 4-terminal method (voltage drop method), which is superior in a low resistance measurement, is used. Using an ohmmeter RM3548 (available from rom Hioki E.E. Corporation):7, terminals are connected to respective cupper electrodes of 1 $cm^2$:10 plated with gold on the surface of anode-oxidization film:2 and on the base substrate layer 4, and then the weight load of 50 $g/cm^2$ is applied to measure the volume resistance. The Vickers Hardness Test represents average film hardness by a microscope cross-section measurement method using a micro hardness meter (HMV-G-XY-D) available from Shimadzu Co. under the weight load of 10 gf for 15 seconds. However, when the film thickness is not more than 20 μm, values are those measured using a knoop type indenter at the same weight load for the same time duration.

An abrasion resistance test is conducted by a reciprocal movement plane abrasion testing machine, and a testing method is performed in accordance with "7.4 General Film Condition of Testing Condition" of JIS-H8682-1 (reciprocal movement plane abrasion test). Furthermore, evaluations are represented by reciprocal sliding number of times per 1 μm, and the abrasion resistance not less than 30 ds/μm may be preferable.

When the average volume resistance value of film formed on the material according to the present embodiment is not more than 10 ($10^{1}$) Ω, an excellent electro-magnetic shield effect may be provided. The measurements of electro-magnetic shield effect has been performed by the KEC method in 100 KHz to 1000 MHz (1 GHz) as the electric field and the magnetic field measurements, as the results, it is preferred that both of the electric and magnetic fields are not less than 30 dB. These value are the same as the value of aluminum base substrate and the shield effects of the almost same with the upper most value of aluminum has been exhibited.

That is, the material according to the present embodiment has the hardness, the abrasion resistance and the corrosion resistance which is hard to be corroded, and hence, the shield effect can be kept for long term basis; in addition, the role as the material hard to be scratched is imparted; moreover, if there is abrasion losses in the film by friction, abrasion, and/or corrosion, the surface of film will be refreshed such that the property that always fresh deposited metal will appear on the surface accordingly will be provided. Thus, the material according to the present embodiment can provide the material having a special structure, which can be continuously used till the film is lost and the production method thereof can be provided.

The corrosion test according to the present invention produces specimens using a neutral salt water spraying testing machine STP-90V-4 (available from Suga Test Instruments Co., Ltd.) under JIS-Z2371 for the continuous spraying in a time duration of 120 hours. In addition, evaluations can be performed by a Rating Number (RN) Method under f JIS-H8679-1 (Evaluation Method of Porous Corrosion Occurred in Anode-Oxidization Film of Aluminum and Aluminum Alloy-Part 1).

More particularly, in the corrosion test, specimens are prepared by the continuous spraying in the time duration of 120 hours using the neutral salt-water spraying testing machine STP-90V-4 (available from Suga Test Instruments Co., Ltd.) under JIS-Z2371. The evaluation method is performed by examining porous corrosion using Rating Number (RN) Method under JIS-H8679-1 (Evaluation of Porous Corrosion Occurred in Anode-Oxidization Film of Aluminum and Aluminum Alloy-Part 1).

Actually, after taken out the specimen from the salt water spraying testing machine, corrosion products are removed physically and chemically, and after drying, the evaluation is performed by comparing with a rating number standard drawing and table. The electro-magnetic shield effect are performed by measuring the electric and magnetic fields within 100 KHz-1000 MHz (1 GHz) in the KEC method and results are represented in an attenuation rate in dB.

Hereinafter, the present invention will be explained using embodiments of particular examples. Here, the present invention is not limited by following embodiments.

Example 1

(Pre-Processing)

A testing piece of aluminum A1050 material (Si 0.25%, Mn not more than 0.05%) of 50×100×t1.0 mm was subjected to pre-processing including: emulsion cleaning at 45° C. for 5 minutes-5% nitrous acid at room temperature×3 minutes-etching by 20% sodium hydroxide at room temperature×1 minute-desmutting by 10% sulfuric acid at room temperature×3 minutes.

(First Step)

A first step used an electrolysis solution including sulfuric acid of 160±5 g/L, oxalic acid of 15±2 g/L as an additive 1 and malonic acid of 8±1 g/L as an additive 2 and was performed at a solution temperature of 0±1° C., a current density of 1.0-1.4 A/dm$^2$ for 90 minutes using a direct-current waveform as a power source. Now, sufficient rinsing was performed between the each of the following steps.

(Second Step and Third Step)

A second step was performed by heating in a thermostatic oven kept at 180° C. for 10 minutes. Then, as a third step, an electrolysis was performed using zinc sulfide of 300 g/L, ammonium sulfide of 30 g/L, boric acid of 30 g/L, and the additive 1 of 15 g/L at the temperature of 25±2° C. under the electrolysis condition of the voltage of 1.0V and an electrolysis duration of 15 minutes, and then sufficient rinsing was applied. The crack number on the film surface obtained was 23 in average for one end face and the widths were 0.8-2.1 μm; an average volume resistance was 3.722 depending on measurement points from 0.02-2502 when measured by the 4-terminal method shown in FIG. 4 between the film surface and the aluminum base substrate; the average film hardness by the microscope cross-section measurement method was HV375; 257 ds/μm was obtained by the reciprocal movement plane abrasion test; an average film thickness was 36.1 μm; and the color tone was dark brown; the corrosion resistance was RN9.5 or more in 120 hours; and the material of which surface partly changed white was obtained. Furthermore, the electro-magnetic shield effect of obtained material was not less than 38 dB for the electric field and was not less than 36 dB for the magnetic field.

Example 2

The material, pre-processing, second step, third step and various measurements were performed according to Example 1, and the electrolysis solution of first step was changed to oxalic acid of 30 g/L and adding sulfuric acid of 5 g/L as the additive 1 together with tartaric acid of 8 g/L as the additive 2 and performed at the solution temperature of 18±1° C. using a pulsed waveform as the power source with setting a cycle of an on-time duration of 6 seconds and an off-time duration of 4 seconds under the current density of 2.0 A/dm$^2$ for 60 minutes. After that, sufficient rinsing was performed between the each of the following steps. As the results, the crack number on the film surface was 8 in average per one end face; the widths were out of measurement due to too narrow values; an average volume resistance by the 4-terminal method of FIG. 4 was 13 KΩ depending on measurement points from 8-27 KΩ; the average film hardness by the microscope cross-section measurement method was HV436; an average film thickness was 21.3 μm; and the color tone was almost dark brown; the corrosion resistance was RN10 in 120 hours; the electro-magnetic shield effect was 30 dB for the electric field and was 30 dB for the magnetic field; and sufficient properties were obtained, though the electric field shield performance and the magnetic field shield performance were lowered when compared to Example 1.

Example 3

The material, pre-processing, first step, third step and various measurements were performed according to Example 1, and the crack numbers, widths, and resistance values when the heating condition in the second step was changed are listed in Table 1. Here, (1) the resistance value of "OV" means an out of range of resistance values and (2) the crack number is all represented by multiples of 5, because the 2 mm square of printed image in the 50 magnification is multiplied by 5.

TABLE 1

| Heating(° C.) | Number/Each | Average Number/ | Widths (μm) | | Resistance Value (Ω) | |
|---|---|---|---|---|---|---|
| 10 min. | End Face | End Face | Min. | Max. | Min.-Max. | Average |
| 100 | 30-25-20-20 | 23.75 | 0.6 | 1.4 | 0.3~130 | 12.4 |
| 150 | 35-25-20-15 | 23.75 | 0.8 | 1.8 | 0.04~37 | 6.3 |
| 200 | 35-25-20-15 | 23.75 | 1.0 | 2.1 | 0.02~25 | 3.7 |
| 250 | 30-25-20-20 | 24.25 | 1.5 | 2.0 | 0.07~12 | 4.7 |
| 300 | 35-30-15-15 | 23.75 | 1.8 | 2.2 | 0.09~8.2 | 3.8 |
| 350 | 35-30-25-15 | 26.25 | 1.8 | 2.0 | 0.05~2.7 | 1.8 |
| 400 | 35-30-20-15 | 25.00 | 2.0 | 2.2 | 0.003~1.7 | 0.28 |

Example 4

The material, pre-processing, second step, third step and various measurements were performed according to Example 1, and the electrolysis solution of the first step was changed to sulfuric acid of 150 g/L and free sulfuric acid of 5 g/L and the electrolysis temperature was 10±1° C.; the current density was 1.0 A/dm$^2$ and the film thickness was 15 μm, and the results are listed in Table 2. The sign "OV" represents the range over.

TABLE 2

| | | Cracks | | | |
|---|---|---|---|---|---|
| Heating 15 min. | Number/ Each End Face | Average Number/ End Face | Min.-Max. Width | Average Widths | Resistance (Ω) |
| 150 | 30-25-25-20 | 25.0 | 0.6-0.8 | 0.7 | 470-810 |
| 350 | 40-40-40-30 | 37.5 | 0.6-0.8 | 0.7 | 350-620 |
| 400 | 40-40-35-30 | 36.2 | 0.8~1.0 | 0.8 | 460-710 |

Comparative Example 1

The material, pre-processing, first step, third step and various measurements were performed according to Example 1, and the second step was omitted, and then the crack numbers, widths, and resistance values were examined depending on the maximum temperature difference among the anode-oxidization process steps in normal procedures. For example, in Example 1, the temperature difference were that between the electrolysis temperature of "0±1° C." and the water rinsing temperature of 15-20° C., and in a normal pore sealing and the anode-oxidization film by JIS-H8601, the temperature difference was that between the electrolysis temperature of "20±1° C." and the process temperature of boiled-water pore sealing of "not less than 95° C.". When crack generation and the volume resistance were compared, the results listed in Table 3 were obtained. The crack widths were out of measurements due to narrower widths and all of the volume resistance values was out of range.

TABLE 3

| Presence Location | Temperature Used | Cracks Ave. Numr/ End Face | Min.-Max. Widths | Ave. Widths | Resistance (Ω) |
|---|---|---|---|---|---|
| Electrolysys-Rinsing | 0° C.-20° C. | 1.75 | — | — | O V |
| Electrolysis-Pore Sealing (Normal Temp.) | 0° C.-30° C. | 2.00 | — | — | O V |
| Electrolysis-Pore Sealing (Boiling Water) | 20° C.-95° C. | 4.50 | — | — | O V |

Comparative Example 2

The material, pre-processing, first step, third step and various measurements were performed according to Example 1, and the second step was performed at 30° C., the hot water of 50° C. with independent combination of the supersonic cleaner at 25 KHz and 100 KHz. The resistance values went out of range in the cases at 30° C. and 50° C., and with the combinations of 30° C., 50° C. and the ultrasonic cleaner, the volume resistance values went out of range as well. In the surfaces, fine cracks were formed.

Example 5

The material, pre-processing, first step, third step and various measurements were performed according to Example 1 and the final voltage was set to be 42V. The second processing step was performed by holding the final voltage of 42V in the first electrolysis for 2 minutes without turning-off the power source; then holding at 40V for 1.5 minutes with decreasing by 2V; further then holding at 35V for 1.5 minutes; holding at 30V for 1.5 minutes. This cycle was repeated until the voltage reached 10V; and after holding the voltage at 10V for 2 minutes, then the voltage was decreased as 8V, 6V, 4V, 2V, and 0V sequentially. The holding time durations were 2 minutes, respectively. It took 21 minutes for reaching 0V, and 0V was held for 4 minutes, and then the specimen was taken out from an electrolysis bath after 25 minutes from the start, and then followed by sufficient water rinsing. After that, the second processing step of Example 1 was performed as the third step and further then the additional third step was applied to prepare the material.

The crack number of film surface in the material obtained was 27 per one end face in average and the widths were 0.6-3.2 μm. The average volume resistance was 0.015 ($1.5\times10^{-2}$) Ω depending on measured positions within 0.006 ($6\times10^{-3}$) Ω-0.04 ($4\times10^{-2}$) Ω when measured by the 4-terminal method of FIG. 4 between the film surface and the aluminum base substrate. The average film hardness was HV378 according to the microscope cross-section measurement; the reciprocal movement plane abrasion test in a general film condition showed 262 ds/μm; the average film thickness was 35.7 μm; the color tone was dark brown; the corrosion resistance was not less than RN9.8 in 120 hours; and the material of which surface changed partly white was obtained. Furthermore, the electro-magnetic field effect was not less than 40 dB for the electric field and was not less than 37 dB for the magnetic field.

While the present invention has been described so far, the present invention should not be limited by the embodiments and examples, and a person skilled in the art may make alternatives, modifications, or variables within an obvious or an equivalent range. Such alternatives, modifications, and/or variables which exhibit the working and/or the effect according to the present invention may fall within the scope of the present invention.

INDUSTRIAL APPLICABILITY

The material according to the present invention is the anode-oxidization film having the low-resistance film not more than 1000($10^3$)Ω and the hardness not less than HV300 altogether, thereby having features of antistatic performances, electro-magnetic shield performances from 500 KHz to 1000 MHz at not more than 1Ω and electronic conductivity such that the material is expected to be used to casings, damage protection by sparking in electronic devices, noise protection by shield effects, electric conductive film which allows to turn on LED-micro-light bulb as a light, hard, and slidable material.

The invention claimed is:

1. An aluminum or aluminum alloy material comprising an anode-oxidization film structure having an anode-oxidization film, a barrier layer and electric conductive metal on a surface of an aluminum base substrate, wherein cracks having widths of 0.1-10 μm viewed from a surface of the anode-oxidation film are present in a range of 10-1000 per 1 $cm^2$ on average and the electric conductive metal is present in the cracks and near surfaces of the cracks, wherein 5% or more of a total crack number reaches the aluminum base substrate passing through the barrier layer, wherein a volume resistance value between the surface of the anode-oxidization film and the aluminum base substrate is not more than 1000 ($10^3$) Ω measured by a 4-terminal method, and wherein the anode-oxidization film has a hardness not less than Vickers Hardness of HV300.

2. The aluminum or aluminum alloy material of claim 1, wherein an average number of the cracks is the average number of the cracks per one end face which cross four end faces of 1 $cm^2$, wherein the cracks include connection points to each other, and wherein the electric conductive metal is present near the surfaces of the cracks.

3. The aluminum or aluminum alloy material of claim 1, wherein the electric conductive metal is deposited or precipitated in liquid or in gas at normal pressure or reduced pressure, and a part of the electric conductive metal is continuous from the surface of the anode-oxidization film to the aluminum base substrate.

4. The aluminum or aluminum alloy material of claim 2, wherein the electric conductive metal is deposited or precipitated in liquid or in gas at atmospheric pressure or reduced pressure, and a part of the electric conductive metal is continuous from the surface of the anode-oxidization film to the aluminum base substrate.

5. The aluminum or aluminum alloy material of claim 1, wherein an abrasion resistance of a layer forming the anode-oxidization film is not less than 30 ds/μm by a reciprocal movement plane abrasion test in a general film condition.

6. The aluminum or aluminum alloy material of claim 2, wherein an abrasion resistance of a layer forming the anode-oxidization film is not less than 30 ds/μm by a reciprocal movement plane abrasion test in a general film condition.

7. The aluminum or aluminum alloy material of claim 3, wherein an abrasion resistance of a layer forming the anode-oxidization film is not less than 30 ds/μm by a reciprocal movement plane abrasion test in a general film condition.

8. The aluminum or aluminum alloy material of claim 1, wherein an average volume resistance value is not more than 10 ($10^1$) Ω, and an electro-magnetic shield effect is not less than 30 dB within a wavelength region of 500 KHz-1 GHz.

9. The aluminum or aluminum alloy material of claim 1, wherein corrosion resistance by a salt-water spraying test machine in 120 hours is not less than RN9.

10. The aluminum or aluminum alloy material of claim 1, wherein the anode-oxidization film has a film thickness of 6-60 μm and is able to adjust color tones.

11. A method of producing an aluminum or aluminum alloy material comprising an anode-oxidization film structure having an anode-oxidization film, a barrier layer and electric conductive metal on a surface of an aluminum base substrate, the method comprising:

forming the anode-oxidization film and the barrier layer by an anode-oxidization process at 0° C.-25° C.;

forming 10-1000 cracks per 1 $cm^2$ on average in the anode-oxidation film, the cracks having widths of 0.1-10 μm when viewed from a surface of the anode-oxidization film, by heating to 100-350° C. in a liquid or in a gas at atmospheric pressure or reduced pressure; and depositing and/or precipitating the electric conductive metal in the cracks and near surfaces of the cracks, wherein 5% or more of a total crack number reaches the aluminum base substrate passing through the barrier layer, wherein a volume resistance value between the surface of the anode-oxidization film and the aluminum base substrate is not more than 1000 ($10^3$) Ω measured by a 4-terminal method, and wherein the anode-oxidization film has a hardness not less than Vickers hardness of HV300.

12. The method of producing an aluminum or aluminum alloy material of claim 11, wherein forming 10-1000 cracks per 1 $cm^2$ comprises forming the cracks in the anode-oxidization film in liquid water or polyalcohol as a single or an admixture, or in gas, wherein the gas comprises argon, carbon dioxide, or air as a single or an admixture, under pressurized or reduced pressure condition from 10 seconds to 30 minutes.

13. The method of producing an aluminum or aluminum alloy material of claim 11, wherein depositing and/or precipitating the electric conductive metal comprises a vibration precipitation process.

* * * * *